US006506232B2

(12) United States Patent
Menear

(10) Patent No.: US 6,506,232 B2
(45) Date of Patent: Jan. 14, 2003

(54) AIR IONIZATION APPARATUS AND METHOD FOR EFFICIENT GENERATION AND CLEANING

(75) Inventor: John E. Menear, Santa Cruz, CA (US)

(73) Assignee: Ion Systems, Inc., Berkeley, CA (US)

( * ) Notice: Subject to any disclaimer, the term of this patent is extended or adjusted under 35 U.S.C. 154(b) by 0 days.

(21) Appl. No.: 09/805,751

(22) Filed: Mar. 13, 2001

(65) Prior Publication Data

US 2002/0129704 A1 Sep. 19, 2002

(51) Int. Cl.[7] ..... B03C 3/78; B03C 3/80

(52) U.S. Cl. ..... 95/59; 96/44; 96/50; 96/62; 96/97

(58) Field of Search ..... 96/97, 44, 46–48, 96/50, 62, 228, 233; 95/58, 59, 74, 75, 281

(56) References Cited

U.S. PATENT DOCUMENTS 2,240,495 A * 5/1941 Dillon et al. ..... 96/97 X
3,159,471 A * 12/1964 Revell ..... 96/46
3,768,258 A * 10/1973 Smith et al. ..... 96/97 X
4,240,809 A * 12/1980 Elsbernd et al. ..... 96/46
4,339,782 A * 7/1982 Yu et al. ..... 96/97 X
4,955,991 A * 9/1990 Torok et al. ..... 96/97 X
5,010,777 A * 4/1991 Yehl et al. ..... 95/75 X
5,667,563 A * 9/1997 Silva, Jr. ..... 96/50
5,843,210 A * 12/1998 Paranjpe et al. ..... 95/59
5,948,141 A * 9/1999 Abdel-Rahman ..... 96/97 X
6,126,722 A * 10/2000 Mitchell et al. ..... 96/97 X

* cited by examiner

*Primary Examiner*—Richard L. Chiesa
(74) *Attorney, Agent, or Firm*—Fenwick & West LLP

(57) ABSTRACT

Ionizing apparatus includes a housing that supports a plurality of ionizing electrodes disposed within fluid apertures that are connected via tubing conduits to pass fluid therethrough about the electrodes. Gas to be ionized is supplied under pressure to the apertures transporting gas ions generated at the electrodes in response to high ionizing voltage supplied thereto. To clean the ionizing apparatus, cleaning liquid is supplied under pressure in one flow direction through the tubing conduits and apertures to remove particles from within the tubing conduits and apertures and from surfaces of the electrodes.

6 Claims, 1 Drawing Sheet

AIR IONIZATION APPARATUS AND METHOD FOR EFFICIENT GENERATION AND CLEANING

FIELD OF THE INVENTION

This invention relates to air ionization apparatus, and more particularly to apparatus of specific design for improved air ion generation and cleaning.

BACKGROUND OF THE INVENTION

Air ionization apparatus is commonly disposed within a work area where electrostatic surface charges are to be neutralized, such as on semiconductor wafers during fabrication of integrated circuits. Contemporary air ionization apparatus for use in large work areas commonly includes so-called ionizer bares that are formed as elongated housings having apertures spaced along the length, with ion electrodes or emitter points positioned within each aperture and connected to sources of positive or negative high voltages suitable for ionizing air about such emitter points. A source of air or relatively inert gas such as nitrogen under pressure is commonly supplied to the housing for escape therefrom through the apertures about the emitter points. In this way, generated air ions are transported away from the emitter points at which they are generated in a flowing stream of air (or gas) to be dispersed throughout the work area. For convenience and safety, generators of the high ionization voltages supplied to the emitter points are mounted within the housing and are powered by lower voltages that can be supplied to such housings with considerably lower required safety precautions. In addition, air or gas under pressure can be supplied to one or more housings through convenient tubing and pressure fittings that facilitate concatenating the installation of such ionizing bars over large work areas.

In such air ionizing apparatus, the pressured air or gas fills the entire housing and contaminant particles are known to precipitate out of the supplied stream of air or gas under pressure and accumulate over time within the housing, particularly within interior regions thereof that are out of the stream of air or gas flowing between an input to the housing and one or other of the outflow apertures. Also, containment particles may accumulate within the housing during and as a result of the various manufacturing processes involved. Thus, contaminant particles are known to collect in comers and crevices within the interior of the housing and about the circuit module inside the housing that generates the high ionizing voltages which are supplied to the emitter points. Periodic cleaning of such conventional ionizing bars is commonly achieved by dismantling the housing to expose the interior and the apertures to cleaning jets of high pressure air manually directed into comers, crevices, and about circuit modules and through the outflow apertures in order to dislodge and expel accumulated contaminant particles. Alternatively, high pressure air supplied at greater pressure and volume than under normal operation can be supplied to the housing to dislodge and expel accumulated contaminant particles, but such cleaning techniques do not reliably expel contaminant particles accumulated in corners and crevices within the housing, and therefore leave contaminant particles available to dislodge and later flow through outflow apertures into the surrounding work area.

SUMMARY OF THE INVENTION

In accordance with one embodiment of the present invention, an ionizing bar is designed for improved fluid inflow and cleaning to promote more thorough and convenient cleaning procedures, and to facilitate generation of air ions with reduced prospects for particulate contaminants being emitted with generated air ions. These benefits are achieved using fluid flow conduits connected between and among the outflow apertures and an inlet to confine operational airflow within fluid flow conduits, and thereby to isolate the supplied air under pressure from the housing surfaces and high-voltage circuit module in the interior of the housing. Tubing connections from the inlet to each aperture assure minimal surface area contacted by air or gas supplied under pressure, and isolates the high-voltage circuit module from contacting any fluid flow out through the apertures. Thus, more rigorous and convenient cleaning procedures can be employed, including passing liquid solvent through confining fluid conduits from the inlet to the apertures for substantially more thorough cleaning, thereby to assure thorough flushing from the system contaminant particles of even smaller sizes (i.e., less than about 2 microns) than can be flushed using conventional jets of pressurized air.

DESCRIPTION OF THE INVENTION

Figure 1:
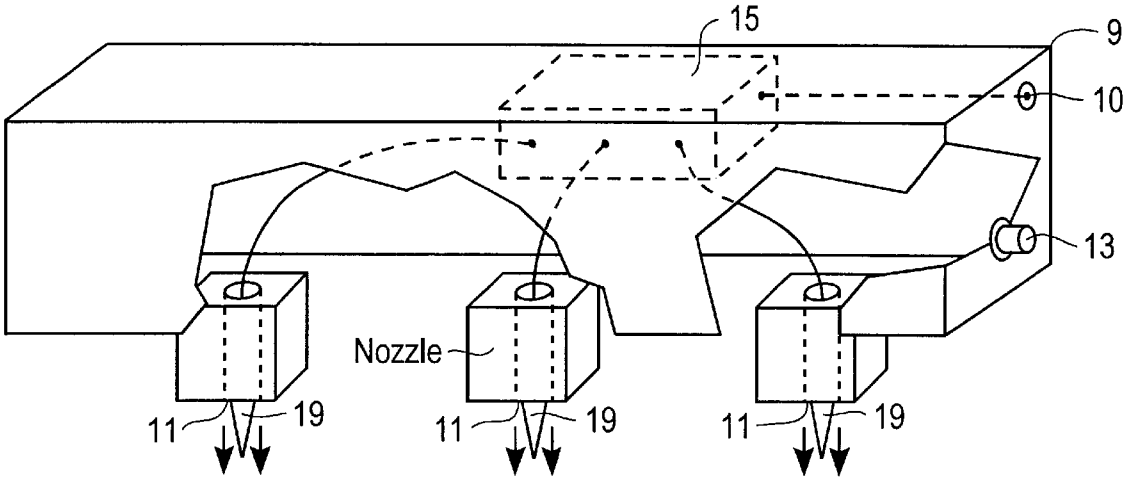
FIG. 1 (PRIOR ART)
FIG. 1 is a cut-away perspective view of a conventional ionizing bar showing the interior configuration of the housing.

Referring now to FIG. 1, there is shown a cut-away view of the housing 9 of a conventional ionizer bar including a plurality of air apertures 11 and an inlet 13 to the housing 9 for connecting a supply of air or other gas under pressure to the housing 9. A conventional circuit module 15 that produces high ionizing voltages is disposed within the housing 9 and is connected to receive relatively low supply voltage 17 (e.g., 24 volts to 120 volts) for applying high positive and/or negative ionizing voltages to the emitter-point electrodes 19 disposed within each of the air outflow apertures 11.

In this configuration, a conventional ionizer bar exposes the entire interior of an air-tight housing 9 to air or other gas under pressure flowing therethrough to the apertures 11. This promotes accumulation of contaminant particles present in the supplied air or gas within corners and crevices and around the circuit module 15, with attendant difficulty for periodic cleaning to assure contaminant-free air flow from the apertures 11.

Figure 2:
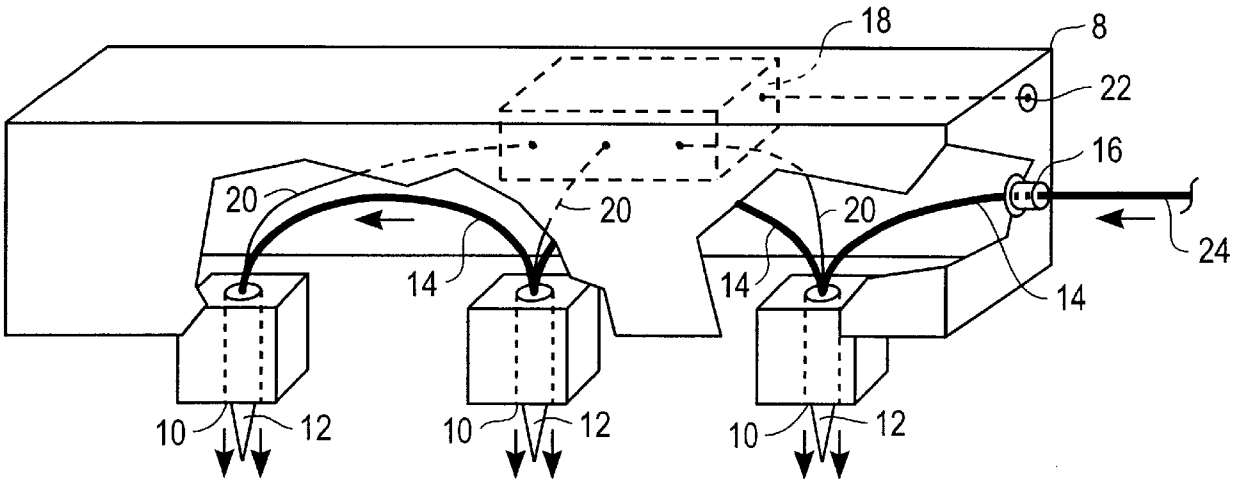
FIG. 2 is a cut-away perspective view of an embodiment of an ionizing bar according to the present invention showing fluid conduits to confine fluid flow within the housing.

In accordance with one embodiment of the present invention, as illustrated in the cutaway perspective view of FIG. 2, a housing 8 includes a plurality of apertures 10, each surrounding an emitter-point electrode 12, and also includes internal conduits 14 specifically connecting a fluid inlet 16 to each of the apertures 10. An internal circuit module 18 generates the high ionizing voltages that are connected 20 to the emitter-point electrodes 12 in response to lower supply voltage (e.g., 24 volts to 120 volts) supplied to a suitable input connector 22. In this configuration, fluid inflow through inlet connector 16 (or inlet tubing 24) is confined to passage only through such conduits (e.g., nylon or teflon tubing) 14 directly to the outflow apertures 10 and has no opportunity to contact the circuit module 18 or interior surfaces of the housing 8.

In operation, a supply of air (or nitrogen) under pressure is supplied through inherently clean, smooth tubing 24 formed of nylon, teflon, or the like, via inflow connector 16 of conventional configuration for distribution by tubing conduits 14 to the outflow apertures 10. The pressure drops across each of the apertures 10 may be arranged to assure substantially uniform air flow from all apertures 10. Crevices or sites for accumulation over time of any contaminant particles within the air or gas supplied via the inlet tubing 24 are substantially reduced, and flowing air or gas has no opportunity to contact other surfaces within housing 8 than the interior bores of the tubing 24, 14.

At prescribed intervals for maintenance and cleaning, the air or gas conduits 24, 14 and apertures 10 connected thereto can be conveniently cleaned by passing liquid under pressure (e.g., deionized water or organic solvents such as isopropyl alcohol through the confining tubing 14, 24 and apertures 10 to flush out any accumulated contaminant particles in the conduits or adhering to the electrodes 12. The flow of such liquid continues in one flushing direction from inlet 16 to outflow apertures 10 for enhanced cleaning of all surfaces in contact with operational air flow. In this way, as a result of the configuration and the cleaning procedure, no contaminant particles anywhere within the interior of the housing 8 can migrate through the apertures 10 to contaminate the work area with which the ionizer bar is associated. And, neither the interior surfaces of the housing 8 nor the circuit module 18 within the housing are vulnerable to damage attributable to flushing the operational air conduits in the manner described. A source of cleaning liquid to be flushed through the conduits 24, 14 or apertures 10 may be prefiltered, for example, through a conventional filter capable of excluding all particulates in excess of 0.1 micron dimensions. The density and wetting properties of liquid solvents, and their ability to dissolve some particulate contaminants, thus significantly improve the cleansing capability according to the structure and method of the present invention when compared with conventional air-jet spraying of entire interior surfaces and structures within a housing of ionizer apparatus.

Therefore, the ionizer bar and method of operation and cleaning such ionizer bar according to the present invention promote higher degrees of exclusion of contaminant particles from an associated work area as a result of confined fluid flow conduits that significantly reduce crevices and anomalies in the flow path with respect to which such contaminant particles can undesirably accumulate and dislodge.

I claim:

1. An ionizing apparatus comprising:

a housing supporting a plurality of fluid outflow apertures, each aperture including an air ionizing electrode disposed therein to interact with fluid outflow from the associated aperture;

a circuit module supported by the housing and connected for supplying high ionizing voltage to each of the electrodes; and fluid-flow tubing terminating at the apertures for supplying fluid under pressure thereto from outside the housing in confined flow paths with smooth interior bore therethrough isolated from surfaces of the housing and from the circuit module supported thereby.

2. Air ionizing apparatus according to claim 1 in which the tubing is capable of supplying gas under pressure through the apertures around air ions generated about the electrodes in response to high ionizing voltages applied thereto.

3. A method for operating gas ionizing apparatus including a housing and fluid apertures disposed about ionizing electrodes supported on the housing and connected to a source of high ionizing voltage within the housing, the method comprising:

supplying a flow of ionizable gas under pressure to the apertures along conduits through the housing that are isolated from the source of high ionizing voltage within the housing; and outflowing the supplied gas through the apertures about the electrodes and the ions of gas produced thereat.

4. The method according to claim 3 including confining the flow of supplied ionizable gas within tubing conduits communicating with each of the apertures.

5. A method of cleaning gas ionizing apparatus having a plurality of gas ionizing electrodes and including a plurality of apertures that are disposed about the gas ionizing electrodes and that are connected via tubing conduits for flowing ionizable gas under pressure therethrough to form ions in response to ionizing voltage applied to the electrodes the method comprising:

flowing liquid cleaning agent through the tubing conduits and apertures without ionizing voltage applied to the electrodes to expel particles resident in the conduits and apertures and to transport particles adherent to the electrodes away from the electrodes and associated apertures.

6. The method according to claim 5 in which flowing liquid cleaning agent includes supplying water under pressure to the tubing conduits in a single direction toward and through the apertures.

* * * * *